US009999569B2

(12) United States Patent
Kriheli

(10) Patent No.: US 9,999,569 B2
(45) Date of Patent: Jun. 19, 2018

(54) NEEDLE VALVE AND CONNECTORS FOR USE IN LIQUID TRANSFER APPARATUSES

(71) Applicant: EQUASHIELD MEDICAL LTD., Tefen Industrial Park (IL)

(72) Inventor: Marino Kriheli, Tel Aviv (IL)

(73) Assignee: EQUASHIELD MEDICAL LTD., Tefen Industrial Park (IL)

( * ) Notice: Subject to any disclaimer, the term of this patent is extended or adjusted under 35 U.S.C. 154(b) by 364 days.

(21) Appl. No.: 14/888,808

(22) PCT Filed: Mar. 25, 2014

(86) PCT No.: PCT/IL2014/050319
§ 371 (c)(1),
(2) Date: Nov. 3, 2015

(87) PCT Pub. No.: WO2014/181320
PCT Pub. Date: Nov. 13, 2014

(65) Prior Publication Data

US 2016/0058667 A1 Mar. 3, 2016

(30) Foreign Application Priority Data

May 9, 2013 (IL) ..... 226281

(51) Int. Cl.
*A61J 3/00* (2006.01)
*A61J 1/20* (2006.01)
(Continued)

(52) U.S. Cl.
CPC ..... *A61J 1/201* (2015.05); *A61J 1/2013* (2015.05); *A61J 1/2048* (2015.05); *A61J 1/2051* (2015.05);
(Continued)

(58) Field of Classification Search
CPC ..... A61J 1/201; A61J 1/2013; A61J 1/2048; A61J 1/2051; A61J 1/2096; A61J 1/22;
(Continued)

(56) References Cited

U.S. PATENT DOCUMENTS 2,601,091 A 6/1952 Butler et al.
3,940,003 A 2/1976 Larson
(Continued)

FOREIGN PATENT DOCUMENTS

IL 214990 2/2013
IL 214990 A 6/2013
(Continued)

OTHER PUBLICATIONS

Communication and Supplementary European Search Report in a counterpart foreign application—EP 14 79 4466, dated Apr. 4, 2017 (13 pages).
(Continued)

*Primary Examiner* — Philip R Wiest
(74) *Attorney, Agent, or Firm* — Roach Brown McCarthy & Gruber, P.C.; Kevin D. McCarthy

(57) ABSTRACT

The invention is a needle valve and connectors for use in liquid transfer apparatuses. The needle valve of the invention is not the conventional type of needle valve known in the art that comprises a threaded valve stem, which allows very accurate control of the flow through the valve, and that uses elastic materials, such as rubber, as a sealing component. The needle valve of the invention comprises two components: the first component is a hollow needle having a smooth exterior surface and a port at the side of the cylindrical shaft, the second component is a seat made of rigid material e.g. plastic with low friction properties.

9 Claims, 10 Drawing Sheets

(51) Int. Cl.
*A61J 1/22* (2006.01)
*A61J 1/14* (2006.01)

(52) U.S. Cl.
CPC ..... *A61J 1/2096* (2013.01); *A61J 1/22* (2013.01); *A61J 1/1406* (2013.01); *A61J 1/2017* (2015.05); *A61J 1/2037* (2015.05); *A61J 1/2055* (2015.05); *A61J 1/2068* (2015.05); *A61J 1/2082* (2015.05)

(58) Field of Classification Search
CPC ..... A61J 1/2017; A61J 1/2037; A61J 1/2055; A61J 1/2068; A61J 1/2082; A61J 1/1406
See application file for complete search history.

(56) References Cited

U.S. PATENT DOCUMENTS

| | | | |
|---|---|---|---|
| 5,474,544 | A | 12/1995 | Lynn |
| 8,196,614 | B2 | 6/2012 | Kriheli |
| 8,267,127 | B2 | 9/2012 | Kriheli |
| 9,510,997 | B2 | 12/2016 | Kriheli et al. |
| 2001/0039401 | A1 | 11/2001 | Ferguson et al. |

FOREIGN PATENT DOCUMENTS

| | | | |
|---|---|---|---|
| JP | 60-501294 | A | 8/1985 |
| WO | 84/04673 | A1 | 12/1984 |
| WO | 2005041846 | A2 | 5/2005 |
| WO | 2012/020084 | A2 | 2/2012 |
| WO | 2014122643 | A1 | 8/2014 |

OTHER PUBLICATIONS

Supplementary Partial European Search Report in a counterpart foreign application—EP 14 79 4466, dated Dec. 14, 2016 (4 pages).

Notification of the First Office Action from the Chinese Patent Office in a counter-part application—201480037133.4; dated May 10, 2017—original (6 pages) and English translation (7 pages).

International Search Report from a counterpart foreign application—PCT/IL2014/050319—dated Jul. 8, 2014; 4 pages.

Written Opinion of the International Searching Authority from a counterpart foreign application—PCT/IL2014/050319—dated Jul. 8, 2014; 8 pages.

Notification of transmittal of international preliminary report on patentability for a counterpart foreign application—PCT/IL2014/050319; dated Nov. 24, 2015; 1 page.

International preliminary report on patentability for a counterpart foreign application—PCT/IL2014/050319; dated Nov. 24, 2015; 10 pages.

Office action from the Japanese Patent Office in a counter-part application—Japanese Patent Application No. 2016-512477; dated Feb. 1, 2018; original (3 pages) and English translation (2 pages).

PRIOR ART

NEEDLE VALVE AND CONNECTORS FOR USE IN LIQUID TRANSFER APPARATUSES

FIELD OF THE INVENTION

The invention is from the field of vales for controlling the flow of liquids or gases. In particular the invention is from the field of valves used to control the flow of liquids or gases in drug transfer systems.

BACKGROUND OF THE INVENTION

Advances in medical treatment and improved procedures constantly increase the need for improved valves and connectors. The demands relating to variety of types, quality, needle safety, microbial ingress prevention and leak prevention are constantly growing. Additionally, advances in sampling or dose dispensing technologies, automated and manual, aseptic or non aseptic applications, call for new safe concealing solutions for the sampling needle. One extremely demanding application exists in the field where medical and pharmacological personnel that are involved in the preparation and administration of hazardous drugs suffer the risk of being exposed to drugs and to their vapors, which may escape to the surroundings. As referred to herein, a "hazardous drug" is any injectable material the contact with which, or with the vapors of which, may constitute a health hazard. Illustrative and non-limitative examples of such drugs include, inter alia, cytotoxins, antiviral drugs, chemotherapy drugs, antibiotics, and radiopharmaceuticals, such as herceptin, cisplatinum, fluorouracil, leucovorin, paclitaxel, etoposide, cyclophosphamideand neosar, or a combination thereof, in a liquid, solid, or gaseous state.

Hazardous drugs in liquid or powder form are contained within vials, and are typically prepared in a separate room by pharmacists provided with protective clothing, a mouth mask, and a laminar flow safety cabinet. A syringe provided with a cannula, i.e. a hollow needle, is used for transferring the drug from a vial. After being prepared, the hazardous drug is added to a solution contained in a bag which is intended for parenteral administration, such as a saline solution intended for intravenous administration.

Since hazardous drugs are toxic, direct bodily contact thereto, or exposure to even micro-quantities of the drug vapors, considerably increases the risk of developing health fatalities such as skin cancer, leukemia, liver damage, malformation, miscarriage and premature birth. Such exposure can take place when a drug containing receptacle, such as a vial, bottle, syringe, and intravenous bag, is subjected to overpressure, resulting in the leakage of fluid or air contaminated by the hazardous drug to the surroundings. Exposure to a hazardous drug also results from a drug solution remaining on a needle tip, on a vial or intravenous bag seal, or by the accidental puncturing of the skin by the needle tip. Additionally, through the same routes of exposure, microbial contaminants from the environment can be transferred into the drug and fluids; thus eliminating the sterility with possibly fatal consequences.

U.S. Pat. No. 8,196,614 and U.S. Pat. No. 8,267,127 to the inventor of the present invention describe closed system liquid transfer devices designed to provide contamination-free transfer of hazardous drugs. FIG. 1 and FIGS. 3*a* to 3*b* are schematic cross-sectional views of the apparatus 10 for transferring hazardous drugs without contaminating the surroundings, according to one embodiment of the invention described in U.S. Pat. No. 8,196,614. The main features of this apparatus that are relevant to the present invention will be described herein. Additional details can be found in the aforementioned patent.

The proximal section of apparatus 10 is a syringe 12, which is adapted to draw or inject a desired volume of a hazardous drug from a fluid transfer component, e.g. a vial 16 or an intravenous (IV) bag in which it is contained and to subsequently transfer the drug to another fluid transfer component. At the distal end of syringe 12 is connected a connector section 14, which is in turn connected to vial 16 by means of vial adaptor 15.

Syringe 12 of apparatus 10 is comprised of a cylindrical body 18 having a tubular throat 20 that has a considerably smaller diameter than body 18, an annular rubber gasket or stopper assembly 22 fitted on the proximal end of cylindrical body 18, hollow piston rod 24 which sealingly passes through stopper 22, and proximal piston rod cap 26 by which a user can push and pull piston rod 24 up and down through stopper 22. A piston 28 made of an elastomeric material is securely attached to the distal end of piston rod 24. Cylindrical body 18 is made of a rigid material, e.g. plastic.

Piston 28, which sealingly engages the inner wall of, and is displaceable with respect to, cylindrical body 18 defines two chambers of variable volume: a distal liquid chamber 30 between the distal face of piston 28 and connector section 14 and a proximal air chamber 32 between the proximal face of piston 28 and stopper 22.

Connector section 14 is connected to the throat 20 of syringe 12 by means of a collar which proximally protrudes from the top of connector section 14 and surrounds throat 20. Note that embodiments of the apparatus do not necessarily have a throat 20. In these embodiments syringe 12 and connector section 14 are formed together as a single element at the time of manufacture, or permanently attached together, e.g. by means of glue or welding, or formed with a coupling means, such as threaded engagement or a Luer connector. The connector section 14 comprises a double membrane seal actuator which is moveable in a reciprocating manner from a normal, first configuration in which the needles are concealed when the double membrane seal actuator is disposed in a first, distal position and a second position in which the needles are exposed when the double membrane seal actuator is proximally displaced. Connector section 14 is adapted to be releasably coupled to another fluid transfer component, which can be any fluid container with a standard connector such as a drug vial, intravenous bag, or an intravenous line to produce a "fluid transfer assembly", through which a fluid is transferred from one fluid transfer component to another.

Connector section 14 comprises a cylindrical, hollow outer body; a distal shoulder portion, which radially protrudes from the body and terminates at the distal end with an opening through which the proximal end of a fluid transfer component is inserted for coupling; a double membrane seal actuator 34, which is reciprocally displaceable within the interior of the body; and one or more resilient arms 35 serving as locking elements, which are connected at a proximal end thereof to an intermediate portion of a cylindrical actuator casing that contains double membrane seal actuator 34. Two hollow needles that function as air conduit 38 and liquid conduit 40 are fixedly retained in needle holder 36, which protrudes into the interior of connector section 14 from a central portion of the top of connector section 14.

Conduits 38 and 40 distally extend from needle holder 36, piercing the upper membrane of actuator 34. The distal ends of conduits 38 and 40 have sharp pointed ends and apertures through which air and liquid can pass into and out of the interiors of the conduits respectively as required during a fluid transfer operation. The proximal end of air conduit 38 extends within the interior of proximal air chamber 32 in syringe 12. In the embodiment shown in FIG. 1, air conduit 38 passes through piston 28 and extends inside of hollow piston rod 24. Air flowing through conduit 38 enters/exits the interior of piston rod 24 and exits/enters to air chamber 32 through an aperture formed at the distal end of piston rod 24 just above piston 28. The proximal end of liquid conduit 40 terminates at the top of or slightly proximally from the top of needle holder 36, so that the liquid conduit will be in fluid communication with the distal liquid chamber 30 via the interior of throat 20 of syringe 12.

Double membrane seal actuator 34 comprises a casing that holds a proximal disc shaped membrane 34*a* having a rectangular cross-section and a two level distal membrane 34*b* having a T-shaped cross-section with disc shaped proximal portion and a disc shaped distal portion disposed radially inwards with respect to the proximal portion. The distal portion of the distal membrane 34*b* protrudes distally from actuator 34. Two or more equal length resilient elongated arms 35 are attached to the distal end of the casing of actuator 34. The arms terminate with distal enlarged elements. When actuator 34 is in a first position, the pointed ends of conduits 38 and 40 are retained between the proximal and distal membranes, isolating the ends of conduits 38 and 40 from the surroundings, thereby preventing contamination of the interior of syringe 12 and leakage of a harmful drug contained within its interior to the surroundings.

Vial adaptor 15 is an intermediate connection that is used to connect connector section 14 to a drug vial 16 or any other component having a suitably shaped and dimensioned port. Vial adaptor 15 comprises a disk shaped central piece to which a plurality of circumferential segments, formed with a convex lip on the inner face thereof for facilitating securement to a head portion of a vial 16, are attached at the circumference of the disk and pointing distally away from it and a longitudinal extension projecting proximally from the other side of the disk shaped central piece. Longitudinal extension fits into the opening at the distal end of connector section 14 to allow transfer of the drug as described herein below. The longitudinal extension terminates proximally with a membrane enclosure having a diameter larger than that of the extension. A central opening in the membrane enclosure retains and makes accessible a membrane 15*a*.

Two longitudinal channels, which are internally formed within the longitudinal extension and that extend distally from the membrane in the membrane enclosure, are adapted to receive conduits 38 and 40, respectively. A mechanical guidance mechanism is provided to insure that the conduits 38 and 40 will always enter their designated channel within the longitudinal extension when connector section 14 is mated with vial adaptor 15. The longitudinal extension terminates distally with a spike element 15*b* which protrudes distally. The spike element is formed with openings in communication with the internally formed channels, respectively and openings at its distal pointed end.

Vial 16 has an enlarged circular head portion attached to the main body of the vial with a neck portion. In the center of the head portion is a proximal seal 16*a*, which is adapted to prevent the outward leakage of a drug contained therein. When the head portion of vial 16 is inserted into the collar portion of vial adaptor 15 and a distal force is applied to vial adaptor 15, the spike element 15*b* of the connector section 14 pierces the seal 16*a* of vial 16, to allow the internal channels in the connector section 14 to communicate with the interior of drug vial 16. When this occurs, the circumferential segments at the distal end of the collar portion of the connector section are securely engaged with the head portion of vial 16. After the seal of vial 16 is pierced it seals around the spike preventing the outward leakage of the drug from the vial. At the same time the tops of the internal channels in vial adaptor 15 are sealed by the membrane 15*a* at the top of vial adaptor 15, preventing air or drug from entering or exiting the interior of vial 16.

The procedure for assembling drug transfer apparatus 10 is carried out as shown in FIGS. 2*a* to 2*d*: Step 1—After the vial 16 and vial adaptor 15 have been joined together, with spike element 15*b* penetrating proximal seal 16*a* of the vial, the membrane 15*a* of vial adaptor 15 is positioned close to the distal opening of connector section 14, as shown in FIG. 2*a*. Step 2—A double membrane engagement procedure is initiated by distally displacing the body of connector section 14 with an axial motion until the membrane enclosure and longitudinal extension of vial adaptor 15 enters the opening at the distal end of the connector section 14, as shown in FIG. 2*b*. Step 3—the distal membrane 34*b* of actuator 34 is caused to contact and be pressed against the stationary membrane 15*a* of vial adaptor 15 by additional distal displacement of the body of the connector section 14. After the membranes are pressed tightly together the enlarged elements at the ends of the arms of the connector section 14 are squeezed into the more narrow proximal section of connector section 14 thereby holding the membranes pressed together and engaged around the longitudinal extension and under the membrane enclosure of vial adaptor 15, as shown in FIG. 2*c*, thereby preventing disengagement of the double membrane seal actuator 34 from vial adaptor 15. Step 4—Additional distal displacement of the body of connector section 14, as shown in FIG. 2*d*, causes actuator 34 to move proximally relative to the body of the connector section 14 until the tips of conduits 38 and 40 pierce the distal membrane of actuator 34 and the membrane at the top of vial adaptor 15 and are in fluid communication with the interior of vial 16. These four steps are performed by one continuous axial motion as connector section 14 is distally displaced relative to the vial adaptor 15, and they will be reversed to separate connector section 14 from vial adaptor 15 by pulling connector section 14 and vial adaptor 15 apart. It is important to emphasize that the procedure is described herein as comprising four separate steps, however this is for ease in describing the procedure only. It is to be realized that in actual practice the secured double membrane engagement (and disengagement) procedure using the present invention is carried out using a single smooth axial movement.

After drug transfer assembly 10 shown in FIG. 1 is assembled as described hereinabove with reference to FIGS. 2*a* to 2*d*, the piston rod 24 can be moved to withdraw liquid from vial 16 or to inject liquid from the syringe into the vial. The transfer of liquid between the distal liquid chamber 30 in the syringe 12 and liquid 48 in the vial 16 and transfer of air between the proximal air chamber 32 in the syringe 12 and air 46 in the vial 16 takes place by an internal pressure equalization process in which the same volumes of air and liquid are exchanged by moving through separate channels symbolically shown in FIG. 1 by paths 42 and 44 respectively. This is a closed system which eliminates the possibility of exchange of air or liquid drops or vapor between the interior of assembly 10 and the surroundings.

FIG. 3*a* schematically shows injection of a liquid into a vial. To inject liquid contained in the liquid chamber 30 of syringe 12 into the vial 16 the drug transfer assembly 10 must be held vertically with the vial at the bottom in an upright position as shown in FIG. 3*a*. Pushing piston 28 distally pushes the liquid out of liquid chamber 30 through conduit 40 into vial 16. Simultaneously, as the volume of liquid chamber 30 is reduced by the distally moving piston, the volume of air chamber 32 is increased. This creates a temporary state of negative pressure in the air chamber and therefore air (or an inert gas) inside vial 16 will be sucked through conduit 38 into air chamber 32. Additionally and simultaneously, as the liquid is added to the vial, the volume available for the air in the vial is reduced creating a temporary state of positive pressure, therefore the air is forced from the vial 16 through conduit 38 into air chamber 32, thus equalizing the pressures in the transfer assembly 10 and equilibrium is reached when piston 28 stops moving.

FIG. 3*b* schematically shows withdrawal of liquid from a vial. To withdraw liquid from the vial 16 and transfer it into the liquid chamber 30 of syringe 12 the drug transfer assembly 10 must be inverted and held vertically with the vial 16 in an upside-down position as shown FIG. 3*b*. For this operation, when apparatus 10 is assembled and the piston 28 in syringe 12 is pulled in the proximal direction, a state of negative pressure is created in liquid chamber 30 and liquid is sucked into it through conduit 40. Simultaneously the volume of air chamber 32 is reduced and air is forced out of it through conduit 38 into the vial (in FIG. 3*b* are shown the air bubbles created by the air entering the vial from air chamber 32). As described in FIGS. 3*a* and 3*b* this simultaneous transfer and replacing of equal volumes of gas and liquids respectively inside syringe and vial constitutes the closed system equalization system.

Despite the care that was taken to separate air path 42 from liquid path 44 there are two locations in the prior art assembly described in U.S. Pat. No. 8,196,614 in which these paths intersect under certain conditions allowing for the possibility of liquid to travel through the air conduit from the distal liquid chamber 30 or vial 16 to the proximal air chamber.

Specifically, in the prior art apparatus described in U.S. Pat. No. 8,196,614 there is a direct connection between the air and liquid channels:

A. inside the double membrane seal actuator 34, when the syringe 12 and attached connection section 14 are not connected to any other fluid transfer component; and B. inside the vial 16 at the tip of the spike, when the apparatus 10 is assembled as shown in FIG. 1.

When part of the liquid does accidently find its way into the air chamber of the syringe, in addition to the obvious problems of esthetics, additional time consuming working steps become necessary to retrieve the drug and correct the dosage.

An example of a scenario when situation A is relevant is when the syringe contains liquid and is being handled, for example when being transported from the pharmacy to the ward. At such a time the piston rod might be accidentally pushed causing some of the drug to migrate to the proximal air chamber above the piston from where it cannot be expelled from the syringe. In such case the plunger needs to be pulled back in order to retrieve the drug, which is an extra work step and the wet residuals in the air chamber 32 cause an aesthetic problem.

An example of a scenario when situation B is relevant is when, during withdrawal of a liquid drug from a vial which is in a typical upside-down position, a bubble of air is seen to enter the liquid chamber of the syringe or when the syringe has been filled with more than the desired volume of liquid. In these situations, accidental pushing on the piston rod to return liquid or bubble to the vial will also cause some liquid to be forced through the air channel into the air chamber in the syringe. The way to remove the bubble is a relatively time consuming and complex procedure involving disconnecting the syringe from the vial and reconnecting it. Special attention is required to avoid pushing the plunger accidentally, which slows down the speed of work.

Israeli patent application IL224630 to the inventor of the present invention describes improvements to the previously described drug transfer devices that minimize or eliminate the above mentioned limitations. Amongst the improvements taught in IL224630 are embodiments of the drug transfer apparatus that comprises a hydrophobic filter inserted in the air channel in at least one location between the air chamber in the syringe and the fluid transfer component and improved vial adaptors.

The inserted filter in the vial adaptor serves as barrier between the liquid and air channels, thus preventing the transfer of liquid through the air channels to the air chamber formed at the back of the syringe. Due to insertion of such barrier the user is free to push small air bubbles or correct small over dosage back into the vial during withdrawal procedure without being concerned that the drug might migrate to the air chamber. On one hand working with filter barrier seems to be an advantage but on the other hand the user is motivated to some negligence and it can be expected that users will not clear the filter from liquid before disconnecting the syringe from the vial and some pressure differentials might remain between the air and liquid chambers of the syringe. Therefore right after disconnection the pressure differentials will seek for neutralization and flow of fluids will occur from the chamber with the higher pressure to chamber with the lower pressure until equilibrium is reached. In case that the lower pressure is in the air chamber, this will suck some of the liquid drug from the liquid chamber to the air chamber through the path existing between both needle tips inside the double membrane seal actuator. To avoid such migration or transfer due to accidental pushing or pulling the plunger and generally to prevent any uncontrolled migration of liquid to air the chamber, the existing path between the needle tips must be eliminated and total isolation of the needles is required.

Such isolation of the needles constitutes a design challenge. On the one hand, membrane 34*b* serves as a barrier between the open ends of the needles 38 and 40 and the environment, preventing contaminants such as microorganisms from contaminating the interior of actuator 34 and the needle tips retained in it, thereby maintaining sterility. On the other hand membrane 34*b* also protects the environment from hazardous substances. While in the previous embodiment in FIG. 1 to FIG. 3*b* where no filter barrier is used, there is no pressure differential created between the air and liquid chambers, and therefore uncontrolled migration doesn't occur, only accidental pushing or pulling can cause transfer of drug between chambers. Such accidental pushing, which (as a side note) is very common, does not create high pressure inside the double membrane seal actuator since there is free flow from chamber to chamber and high pressure cannot be maintained and collapses immediately until equilibrium is reached. Therefore the sealing properties of the elements in the actuator are never challenged with high pressure and moderate design is sufficient. On the other hand, in embodiments according to IL224630 (see for example FIG. 10 herein below) where a filter is inserted as a barrier, there is a requirement for high pressure resistance due to the high pressures of up to 20 atmospheres that can be easily generated by manually pushing the syringe plunger. This phenomenon is especially common with small volume syringes (1-5 ml). Under such pressures most of the isolation designs between the needles will fail and drug will be transferred to the air chamber or even worse, the membranes 34*a* and 34*b* cannot resist high pressures, which can cause them to detach from their seat or can cause a leak through the channels in the membranes that were created by the needles during piercing the resilient material of the membrane.

A solution for withstanding the high pressures would also be a general improvement for regular needle valves and connectors since a device that can withstand higher pressures performs even better at moderate requirements. Such performance improvement can be used also in the field of sampling or dose dispensing technologies, both, automated and manual. In this field the needle is exposed for sampling or dispensing procedure and after the procedure is accomplished there is a need to retract the needle into a protective envelope to avoid both, the contamination of the needle or contamination of the environment by the needle.

It is therefore a purpose of the present invention to provide needle valves that overcome the above described problems caused by high pressure within a liquid transfer apparatus.

It is therefore a purpose of the present invention to provide improved membrane actuators based on the new needle valves that overcome the above described problems caused by high pressure within a liquid transfer apparatus.

Further purposes and advantages of this invention will appear as the description proceeds.

SUMMARY OF THE INVENTION

In a first aspect the invention is a needle valve comprised of:

a. at least one hollow needle comprised of a smooth surfaced hollow shaft and a port located in the side of the shaft at the distal end close to the tip of the needle, the port adapted to allow fluid communication between the interior and the exterior of the needle; and b. a seat made of rigid material, the seat comprising at least one bore adapted to accommodate one of the at least one needles through the seat;

wherein:

i. said needle can be pushed back and forth through said bore; and ii. the outer diameter of said needle and the inner diameter of at least part of said bore are so closely matched that the presence of the shaft of said needle in said bore blocks the passage of fluid through said part of said bore.

In embodiments of the needle valve of the invention the seat is made of plastic with low friction properties, which can be acetal plastic.

Embodiments of the needle valve of the invention comprise a lubricant for reducing the friction between the needle and the seat.

In a second aspect the invention is a connector for connecting two components of a fluid transfer apparatus to each other comprising a needle valve according to the first aspect of the invention. The connector comprises:

i. a cylindrical, hollow outer body;

ii. a connection port adapted to connect to a first fluid transfer component, the connection port located on the outside of the outer body at its proximal end;

iii. a needle holder located on the inside of the outer body at its proximal end;

iv. a needle that functions as a fluid conduit, wherein the needle passes through and is rigidly attached to the needle holder, the distal end of the needle comprises at least one port that allows fluid communication between the outside and the inside of the needle;

v. a single membrane seal actuator reciprocally displaceable within the hollow interior of the connector section; the single membrane seal actuator comprising:

a cylindrical actuator casing;

a distal membrane that seals the distal end of the casing, wherein a part of the distal membrane protrudes distally from the casing; and at least one resilient arm which is connected at a proximal end thereof to an intermediate portion of the exterior of the casing and comprises enlarged locking elements at its distal end; the enlarged locking element having specifically shaped surface areas which interact with an inner wall of the hollow cylindrical outer body of the connector section to enable a four step procedure for connecting or separating the connector section to a second fluid transfer component.

The connector of the invention is characterized in that the single membrane seal actuator comprises a rigid plastic needle valve seat located proximally of the membrane, the needle valve seat comprising a bore, wherein the bore is adapted to each allow the needle to be pushed back and forth through it and at least a portion of each of the bore is adapted such that fluid cannot pass through the portion when the needle is at least partially located in the bore;

wherein, the connector is configured to allow a head portion of the second fluid transfer component to enter the interior of the connector section and to allow the single membrane actuator to be pushed proximally when the membrane at its distal end is contacted by a membrane located in the head portion of the second fluid transfer component; whereupon further pushing of the membranes together causes the distal end of the needle to exit the distal end of the bore and to penetrate the membrane in the single membrane actuator and to penetrate the membrane in the head portion, thereby establishing a fluid channel via the needle between the connection port and the interior of the second fluid transfer component.

In embodiments of the connector of the invention the port at the distal end of the needle that allows exchange of fluid between the surroundings and the hollow interior of the needle is completely blocked by the interior of the bore in seat of the needle valve when the connector is not connected to a second fluid transfer component.

In a third aspect the invention is a fluid transfer apparatus that comprises a connector according to the second aspect. The fluid transfer apparatus comprises:

a. a syringe-like proximal section comprising:

i. a cylindrical body;

ii. a piston that is displaceable within the cylindrical body, the piston defining a distal liquid chamber and a proximal gas chamber, both of variable volume;

b. a connector section attached to the distal end of the proximal section, wherein the distal end of the connector section is adapted to be connectable to a fluid transfer component, the connector section comprising:

i. a cylindrical, hollow outer body;

ii. a needle holder;

iii. a first needle that functions as a liquid conduit, wherein the first needle passes through and is rigidly attached to the needle holder, the distal end of the first needle comprises at least one port that allows fluid communication between the outside and the inside of the first needle, the distal end of the first needle is located in the connector section, and the proximal end of the first needle is located in the liquid chamber;

iv. a second needle that functions as a gas conduit, wherein the second needle passes through and is rigidly attached to the needle holder, the distal end of the second needle comprises at least one port that allows fluid communication between the outside and the inside of the second needle, the distal end of the second needle is located in the connector section, and the proximal end of the second needle is located in the gas chamber;

v. a single membrane seal actuator reciprocally displaceable within the hollow interior of the connector section; the single membrane seal actuator comprising:

a cylindrical actuator casing;

a distal membrane that seals the distal end of the casing, wherein a part of the distal membrane protrudes distally from the casing; and at least one resilient arm which is connected at a proximal end thereof to an intermediate portion of the exterior of the casing and comprises enlarged locking elements at its distal end; the enlarged locking element having specifically shaped surface areas which interact with an inner wall of the hollow cylindrical outer body of the connector section to enable a four step procedure for connecting or separating the connector section to a fluid transfer component.

The fluid transfer apparatus of the invention is characterized in that the single membrane seal actuator comprises a rigid plastic needle valve seat located proximally of the membrane, the needle valve seat comprising two bores, wherein each of the bores is adapted to each allow one of the first and second needles to be pushed back and forth through it and at least a portion of each of the bores is adapted such that fluid cannot pass through the portion when the first and second needles are at least partially located in the respective one of the bores;

wherein, the connector section is configured to allow a head portion of the fluid transfer component to enter the interior of the connector section and to allow the single membrane actuator to be pushed proximally when the membrane at its distal end is contacted by a membrane located in the head portion of the fluid transfer component; whereupon further pushing of the membranes together causes the distal ends of the first needle and the second needle to exit the distal end of their respective bores and to penetrate the membrane in the single membrane actuator and to penetrate the membrane in the head portion, thereby establishing a liquid channel via the first needle between the interior of the liquid chamber and the interior of the fluid transfer component and a separate gas channel via the second needle between the interior of the gas chamber and the interior of the fluid transfer component.

In embodiments of the fluid transfer apparatus of the invention the ports at the distal ends of both the first needle and the second needle are located in the seat of needle valve and are fully sealed by the bores in which they are located thereby isolating the interiors of the first needle and the second needle from each other when the distal end of the connector section is not attached to any other fluid transfer component.

In embodiments of the fluid transfer apparatus of the invention the ports at the distal ends of both the first needle and the second needle are located in the seat of needle valve and are open thereby allowing fluid communication between the interiors of the first needle and the second needle when the distal end of the connector section is not attached to any other fluid transfer component.

All the above and other characteristics and advantages of the invention will be further understood through the following illustrative and non-limitative description of embodiments thereof, with reference to the appended drawings.

DETAILED DESCRIPTION OF EMBODIMENTS OF THE INVENTION

The present invention is a new type of needle valve and connectors for use in liquid transfer apparatuses that comprise the needle valve. The needle valve of the invention is not the conventional type of needle valve known in the art that comprises a threaded valve stem, which allows very accurate control of the flow through the valve, and that uses elastic materials, such as rubber, as a sealing component. The needle valve of the invention comprises two components: the first component is a hollow needle having a smooth exterior surface and a port at the side of the cylindrical shaft, the second component is a seat made of rigid material e.g. plastic with low friction properties. A lubricant for further reducing the friction between the needle and the seat is desired and preferred, but the needle valve works also without a lubricant.

Figure 1:
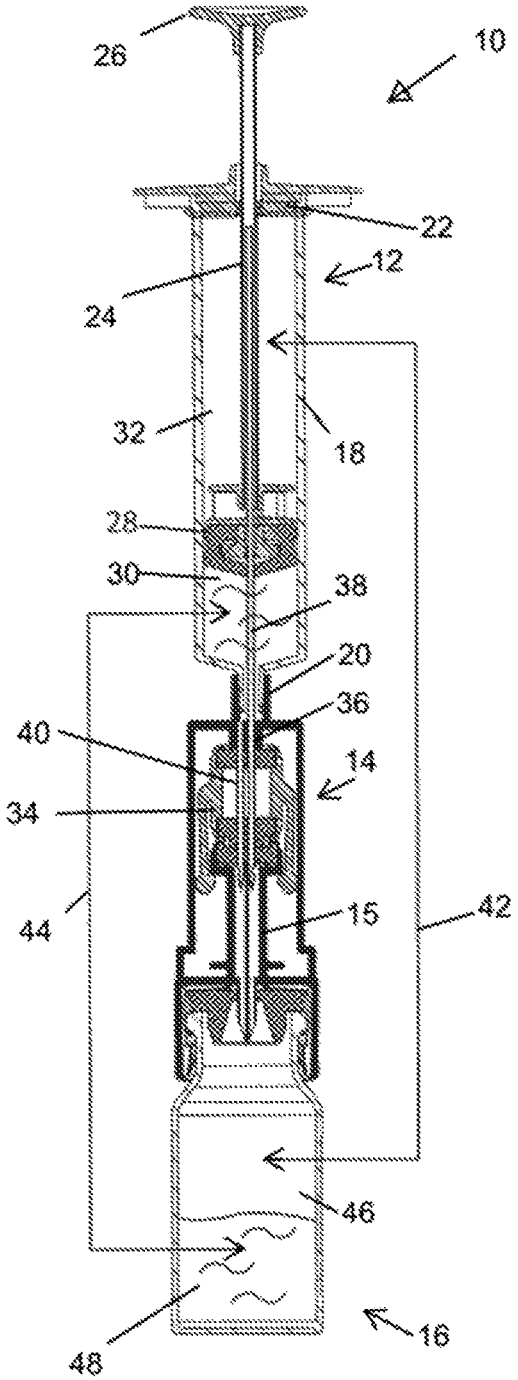
PRIOR ART Fig. 1
FIG. 1 is a schematic cross-sectional view of a prior art apparatus for transferring hazardous drugs.
Figure 4A:
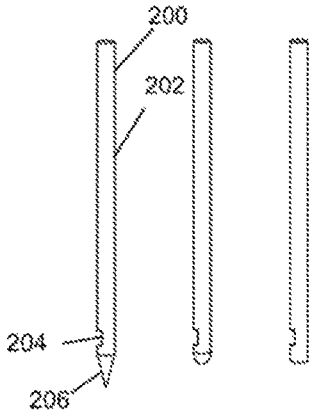
FIG. 4*a*, FIG. 4*b*, and FIG. 4*c* schematically show the needle valve of the invention.

FIG. 4*a* shows three embodiments of hollow needle 200 such as needles 38 and 40 in FIG. 1. Needle 200 comprises a smooth surfaced hollow shaft 202 and a port 204 located in the side of the shaft at the distal end close to tip 206. Port 204 allows fluid communication between the interior of shaft 202 and the exterior of the shaft. Tip 206 is generally pointed as shown in FIG. 4*a*, but in embodiments of the valve the tip can have other shapes, e.g. round or flat.

Figure 4B:
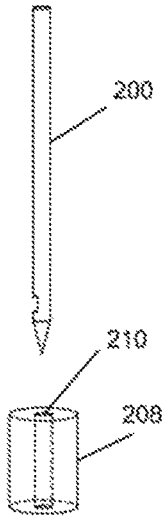

FIG. 4*b* shows the simplest embodiment of the seat 208 of the valve. In this embodiment, seat 208 is a cylindrical block of a rigid material such as acetal plastic, with a bore 210 through it.

Figure 4C:
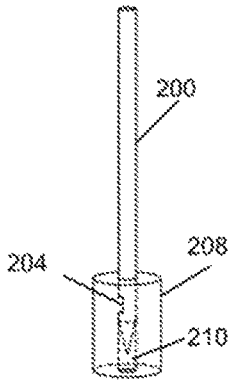

FIG. 4*c* shows the shaft of the needle inserted into the bore in the seat. The seat 208 is made of a rigid material such as acetal plastic, which has good dimensional stability and a very low coefficient of friction. This allows the valve to be manufactured with the outer diameter of needle 200 and the inner diameter of bore 210 so closely matching that, on the one hand, needle 200 can be pushed back and forth through bore 210 and, on the other hand, the presence of the shaft 202 of needle 200 in the bore 210 blocks the passage of fluid (gas or liquid) through bore 210.

FIG. 5*a* to FIG. 8*b* are cross-sectional views that schematically show different embodiments of the needle valve of the invention. Each of these figures shows two views of the valve. In the left view (labeled a) the port 204 is located within the bore 210 in the seat 208 and in the right view (labeled b) the needle has been pushed distally so that the port 204 has exited the bore 210.

In the embodiment of the valve shown in FIG. 5*a* and FIG. 5*b* fluid communication between the outside and the interior of the shaft 202 through port 204 is blocked by the walls of the bore in FIG. 5*a* and is allowed between the space below the valve and the interior of the needle in the FIG. 5*b*. In this embodiment, no matter what the position of the port 204 relative to seat 208 there is no fluid communication between the interior of the needle and the space above the valve.

Figure 6A:
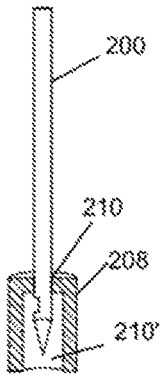
Figure 6B:
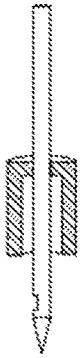

In the embodiment of the valve shown in FIG. 6*a* and FIG. 6*b* the diameter of bore 210 in seat 208 is increased after bore 210 penetrates a short distance into seat 208 creating a chamber 210' having a much larger diameter then that of the shaft 202 of needle 200. In this embodiment bore 210 seals the shaft 202 above the port 204, thereby preventing fluid communication between the space above the valve and the interior of the needle but always allowing fluid communication between the space below the valve and the interior of the shaft 202 through port 204 is always allowed.

Figure 7A:
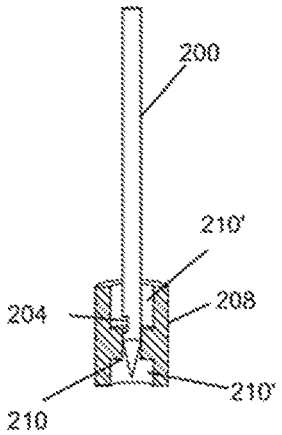
Figure 7B:
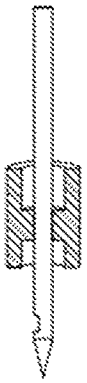

In the embodiment of the valve shown in FIG. 7*a* and FIG. 7*b* the bore through the seat 208 is created with chambers 210' at the top and bottom and a section of the bore 210 having diameter essentially equal to that of the outer diameter of the shaft 202 of needle 200. This embodiment allows fluid communication between the space above the valve and the interior of the shaft 202 through port 204 as shown in FIG. 7*a* and between the space below the valve and the interior of the needle as shown in FIG. 7*b*.

Figure 5A:
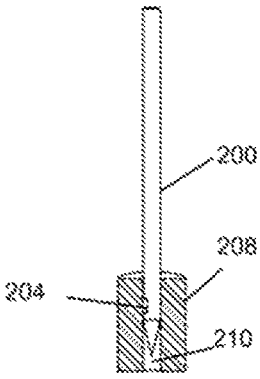
FIG. 5*a* to FIG. 8*b* are cross-sectional views that schematically show different embodiments of the needle valve of the invention.
Figure 5B:
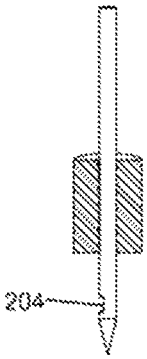
Figure 8A:
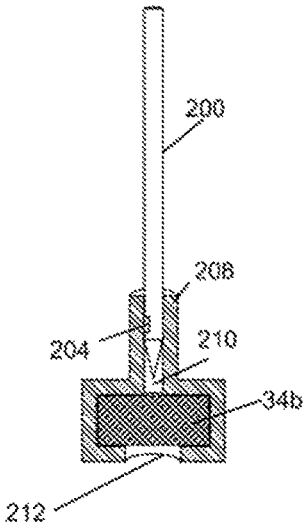
Figure 8B:
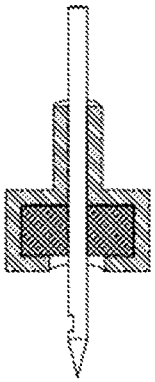

In the embodiment of the valve shown in FIG. 8*a* and FIG. 8*b*, the valve is identical with the valve shown in FIG. 5*a* and FIG. 5*b* and in addition the bottom of the seat comprises a recess 212 into which a resilient elastic membrane 34*b* is inserted. The membrane serves as a barrier between the port 204 and the environment, preventing contaminants such as microorganisms from contaminating the bore and the needle tip retained in it, thereby maintaining sterility. On the other hand the membrane also protects the environment from hazardous substances present as residuals on the needle tip, which might be present after transfer of fluids through the needle.

Figure 9A:
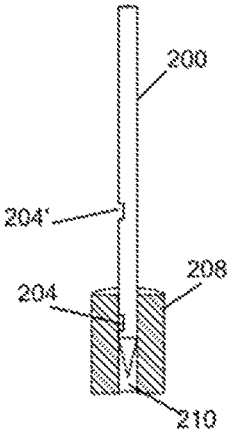
FIG. 9*a* and FIG. 9*b* schematically show an embodiment of the needle valve of the invention that comprises two ports that allow fluid communication between the outside and interior of the needle shaft.
Figure 9B:
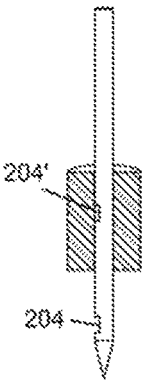

FIG. 9*a* and FIG. 9*b* schematically show an embodiment of the needle valve of the invention that comprises two ports that allow fluid communication between the outside and interior of the needle shaft. In FIG. 9*a* port 204 is blocked by the walls of bore 210 and fluid communication between the space above the valve and the interior of the needle is allowed through port 204'. In FIG. 9*b* fluid communication between the space below the valve and the interior of the needle is allowed through port 204 while the port 204' is blocked. This embodiment of needle valve is usable in applications with more than one fluid chamber that needs to be accessed by the needle ports, such as reconstitution devices. Typically such devices have chambers for lyophilized powder and chambers for diluents. A membrane pierced by the shaft and located between port 204' and the top of seat 208 can be used to separate the multiple chambers. It is noted that embodiments of the needle valve of the invention similar to the embodiment shown in FIG. 9*a* and FIG. 9*b* with three or more ports in the side of the needle can be produced.

Figure 9C:
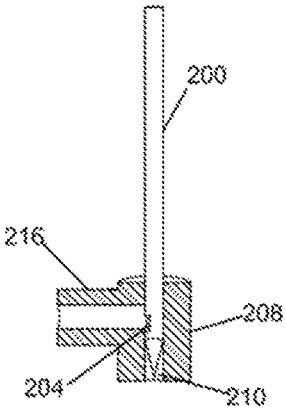
FIG. 9*c* and FIG. 9*d* schematically show an embodiment of the needle valve of the invention in which the seat of the valve comprises a side channel that allows fluid communication between the interior of the needle shaft and a remote location via the port in the side of the needle.
Figure 9D:
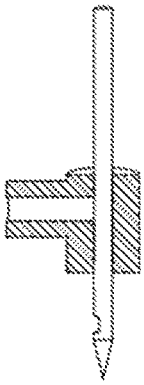

FIG. 9*c* and FIG. 9*d* schematically show an embodiment of the needle valve of the invention in which the seat 208 of the valve comprises a side channel 216 that allows fluid communication between the interior of the needle shaft and a remote location (not shown) via the port 204 in the side of the needle 200.

The needle valve embodiments described in FIG. 4*a* to FIG. 9*d* allow a variety of uses for special needs. They allow improved designs in comparison to existing valves and connectors, improved resistance to high pressures and thereby improved general performance.

Figure 10A:
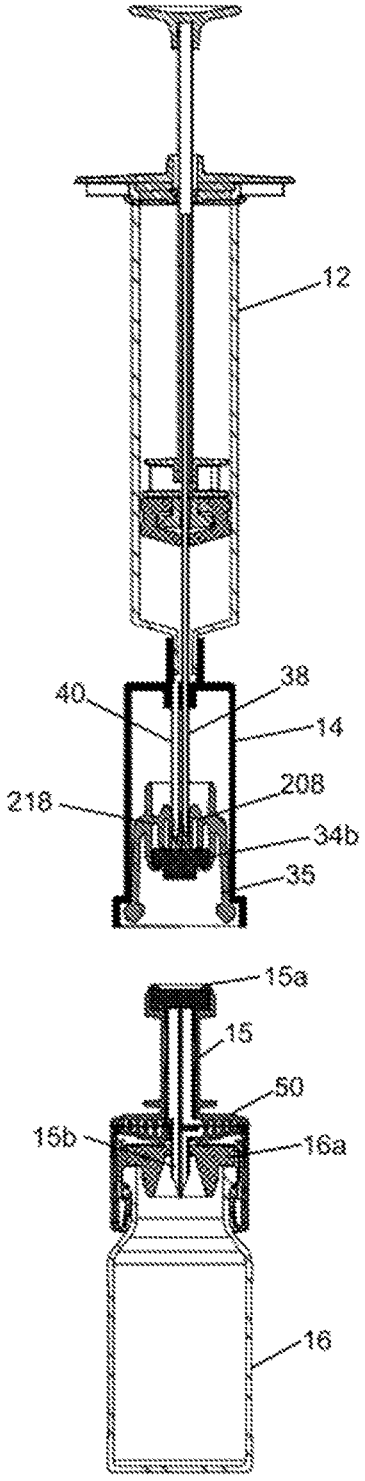
FIG. 10*a* and FIG. 11*a* are schematic cross-sectional views of an apparatus for transferring hazardous drugs identical to that shown in FIG. 1 and FIG. 2*a* respectively, with the exception that the prior art double membrane seal actuator is replaced with an actuator comprising an embodiment of the needle valve of the present invention.
Figure 10B:
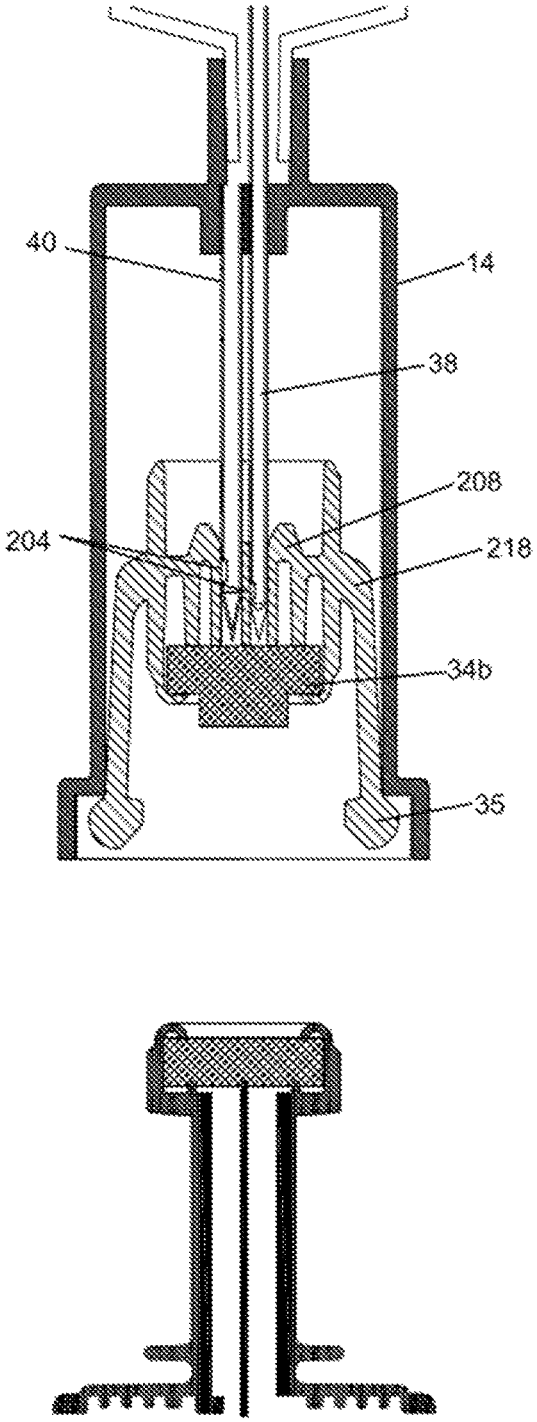
FIG. 10*b* and FIG. 11*b* are enlarged views of the actuator in the apparatus shown in FIG. 10*a* and FIG. 11*a* respectively.
Figure 11A:
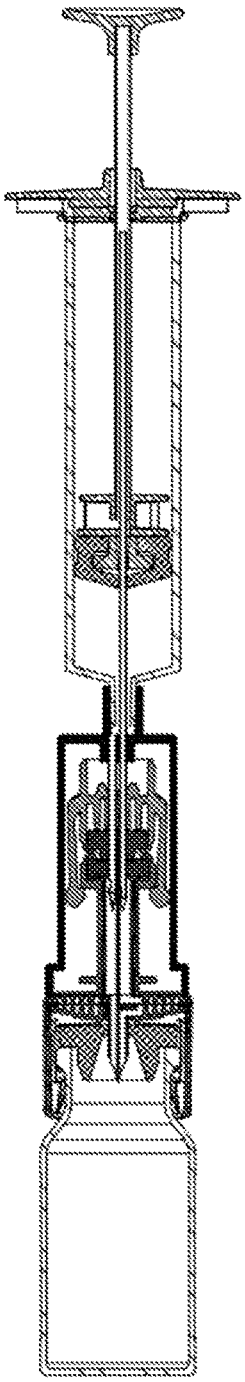

FIG. 10*a* and FIG. 11*a* are schematic cross-sectional views of an apparatus for transferring hazardous drugs. The apparatus and all of the components shown in these figures are identical to those shown in FIG. 1 and FIG. 2*a* respectively, with two exceptions. The vial adaptor 15 comprises a filter 50, as described in IL224630 and the prior art double membrane seal actuator 34 in the connector section 14 comprising two membranes 34*a* and 34*b* and arms 35 is replaced with an actuator 218 comprising an embodiment of the needle valve of the present invention, only one membrane 34*b*, and arms 35. It is important to note that in all embodiments of the present invention, including those shown in FIG. 10*a* through 13*b*, it is not necessary to seal the proximal end of actuator 218 in any fashion because the task of enclosing the bores 204 at the distal ends of the air and liquid conduits when the connector is not connected to another fluid transfer component, which in the prior art was accomplished by membranes 34*a* and 34*b*, is accomplished in the present invention by the needle valve arrangement and membrane 34*b* alone and in some embodiments by the needle valve itself.

Figure 11B:
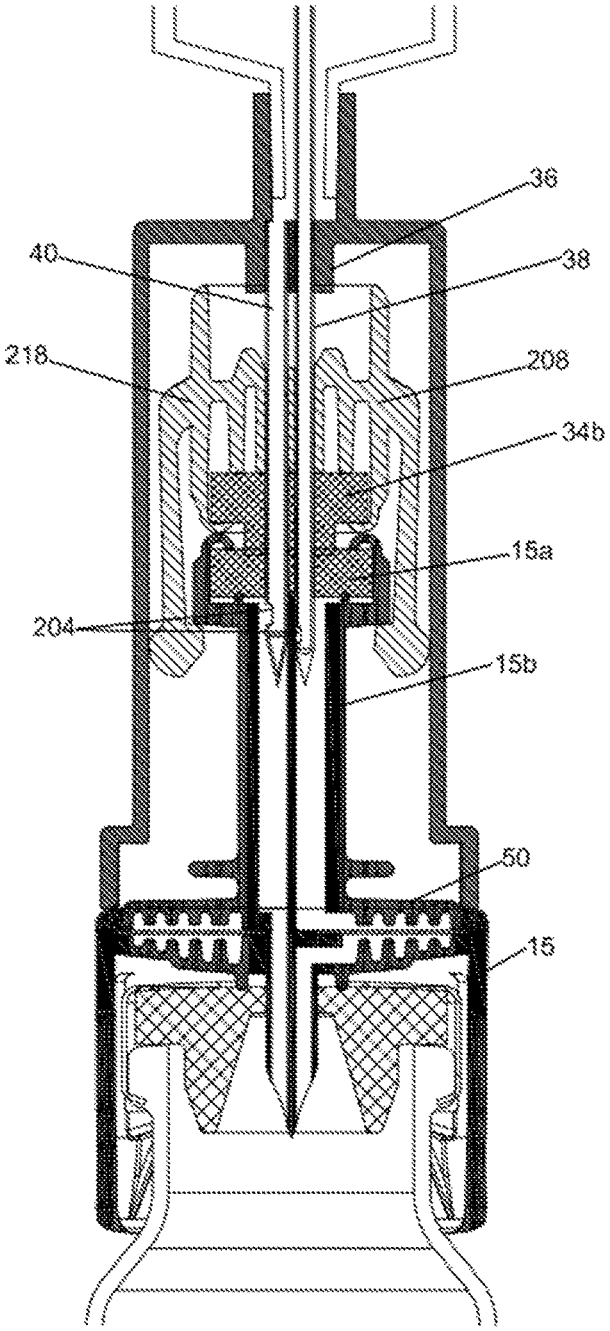

FIG. 10*a* shows syringe 12 attached to connector section 14 and vial adaptor 15 connected to drug vial 16. FIG. 11*a* shows all components of the apparatus connected together. FIG. 10*b* and FIG. 11*b* are enlarged views of the actuator in the apparatus shown in FIG. 10*a* and FIG. 11*a* respectively.

Referring to FIG. 10*b* and FIG. 11*b*, actuator 218 comprises a valve seat 208 comprising two bores through which the needles of air conduit 38 and liquid conduit 40 pass. All parts of the actuator (with the exception of membrane 34*b* and needles 38 and 40) are made from rigid low friction plastic, e.g. acetal, so that needles 38 and 40 slidingly fit into the bores in the seat while preventing passage of liquid or air through the bores. The diameters of the shaft and the bores require fine tuning during the product development phase, since tighter bore causes higher friction and higher pressure resistance, while less tighter bores cause less friction and moderate pressure resistance. The surface quality of the needle influences the friction, as well as the lubricant applied during the manufacture process. Materials such as acetal have excellent low friction properties and allow the valve to function even after the lubricant has been removed due to repeated connections and exposure to aggressive substances in the drugs.

When the syringe and attached connector are not connected to any other component of the apparatus, as shown in FIG. 10*b*, the actuator 218 is at the distal end of connector section 14 and the tips of needles 38 and 40 are located in the bores in the seat 208 of the needle valve. In this configuration the ports 204 in the sides of the needles are blocked by the interior walls of the bores completely isolating the needles from each other, thereby preventing air from entering the liquid chamber of the syringe or liquid from entering the air chamber even at very high pressures.

When the syringe and attached connector are connected to another component of the apparatus, such as a vial adaptor as shown in FIG. 11*b*, the actuator 218 is pushed towards the proximal end of connector section 14. Since needles 38 and 40 are fixed to the needle holder 36, as actuator 218 moves proximally, the tips of needles 38 and 40 and ports 204 are pushed out through the distal end of the bores in the seat 208 of the needle valve, through membrane 34*b*, and through membrane 15*a* of the vial adaptor, thereby establishing open fluid paths in the respective channels.

The first goal for the connector is to completely eliminate the possibility of migration of liquid to the air chamber. This can happen, for example, if pressure differentials between the air and liquid chambers exist after disconnection from a vial adaptor and if the pressure in the air chamber is lower than that in the liquid chamber, resulting in undesired migration of liquid to the air chamber. The second goal is to prevent leaks or damage to the connector during accidental pushing of the syringe plunger. One of the frequently performed drug transfer operations in hospital settings is known as IV push or bolus injection. Typically the required amount of drug is prepared in a syringe in the hospital pharmacy and delivered to the ward where a qualified nurse administers to the patient the drug through a previously established IV line. A common problem associated with the procedure is that during the trip from pharmacy to ward or at bedside the piston of the syringe is sometimes unintentionally pushed expelling some of the drug from the barrel of the syringe or unintentionally pulled, High pressures of up to 20 atmospheres can be easily generated by manually pushing the plunger of small volume syringes (1-5 ml). Such pressure may cause the connector to disintegrate or the membranes to be detached. The connector shown in FIG. 10*a* through FIG. 11*b* solves the problems associated with such unintended transfer of fluids between the air and liquid chambers and resists high pressures created during accidental pushing the of plunger. As can be seen in these figures, when the connector 14 is not connected to the adapter 15, the ports 204 at the distal end of needles 38 and 40 that allow exchange of fluid between the surroundings and the hollow interiors of the needles are blocked by the interior of the bore in seat 208 of the needle valve. If the syringe is filled or partially filled with liquid, then no matter how much force is exerted to try to push the plunger forward and to force liquid to flow through the needle, no liquid can exit the needle through port 204. Conversely, no matter how much force is exerted to pull the plunger backwards no air can enter through port 204 and flow through the interior of the needle into the barrel of the syringe.

Figure 12:
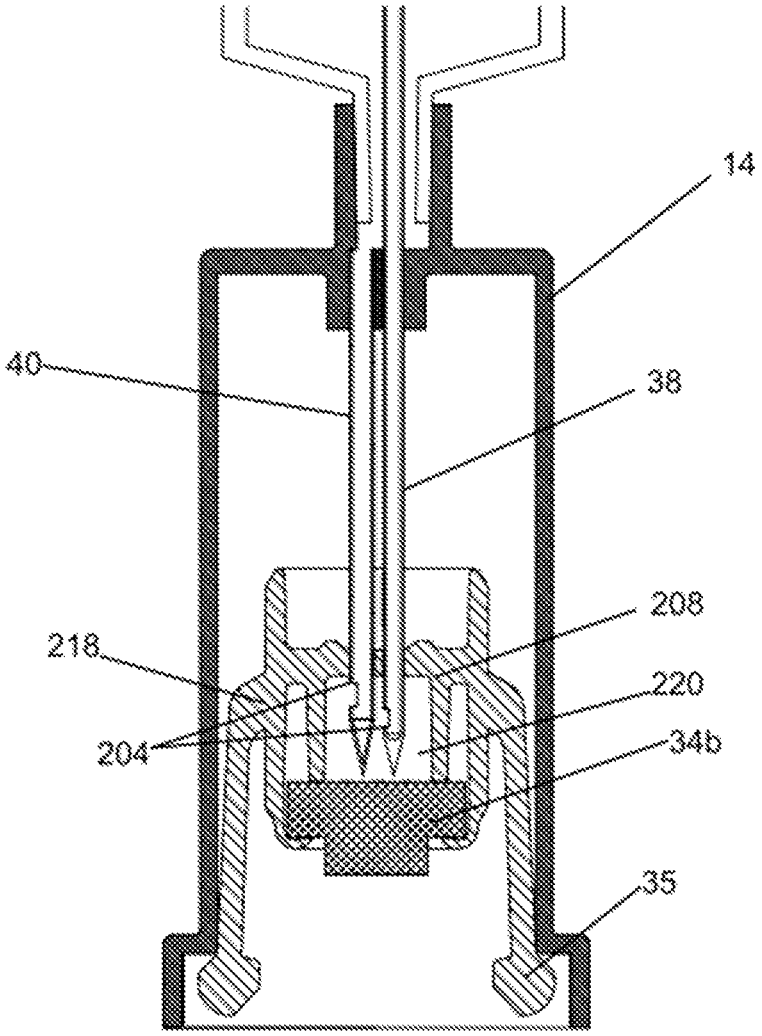
FIG. 12 shows another embodiment of an actuator comprising another embodiment of the needle valve of the invention that could be used in the apparatus of FIG. 10*a* and FIG. 10*b;*

FIG. 12 shows another embodiment of an actuator 218 comprising another embodiment of the needle valve of the invention that could be used in the apparatus of FIG. 10*a* and FIG. 10*b*. In this embodiment the seat 208 of the needle valve is constructed such that, when the syringe and attached connector are not connected to any other component of the apparatus, the actuator 218 is at the distal end of connector section 14 as shown in the figure. In this configuration the tips and the ports 204 in the sides of needles 38 and 40 are located in the enclosed space 220 between seat 208 of the needle valve and membrane 34*b*. In this configuration exchange of liquid and air can take place via the two needles.

This connector is similar to the needle valve described in embodiment shown in FIG. 6*a* and FIG. 6*b*. In this embodiment the seat 208 seals the shaft of the needles 38 and 40 above the ports 204, thereby preventing fluid communication between the environment above the actuator 218 and the interior of the space 220.

Figure 2A:
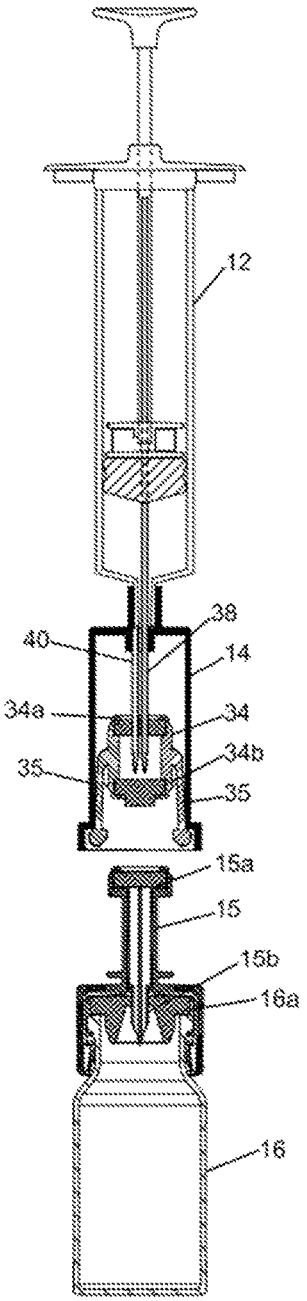
FIG. 2*a* to FIG. 2*d* are cross-sectional views that schematically show the 4 steps connection sequence between the connector section and the vial adaptor of the apparatus of FIG. 1.
Figure 2B:
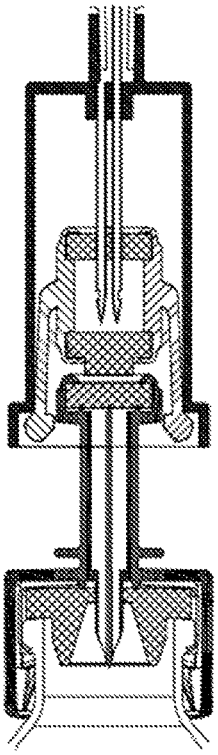
PRIOR ART Fig. 2b
Figure 2C:
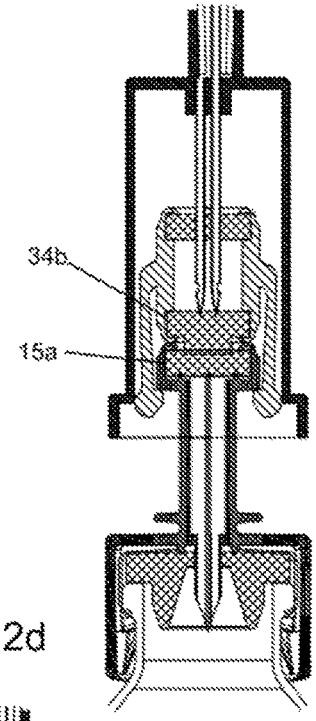
PRIOR ART Fig. 2c
Figure 2D:
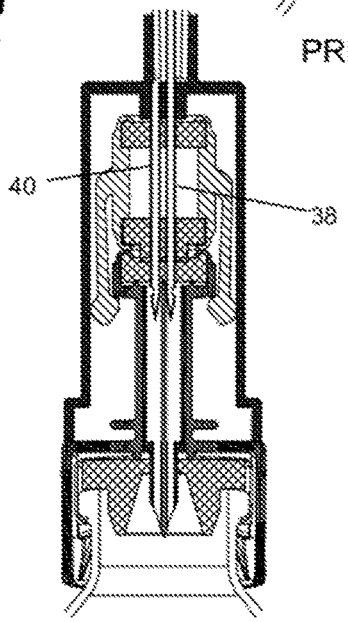
PRIOR ART Fig. 2d
Figure 3A:
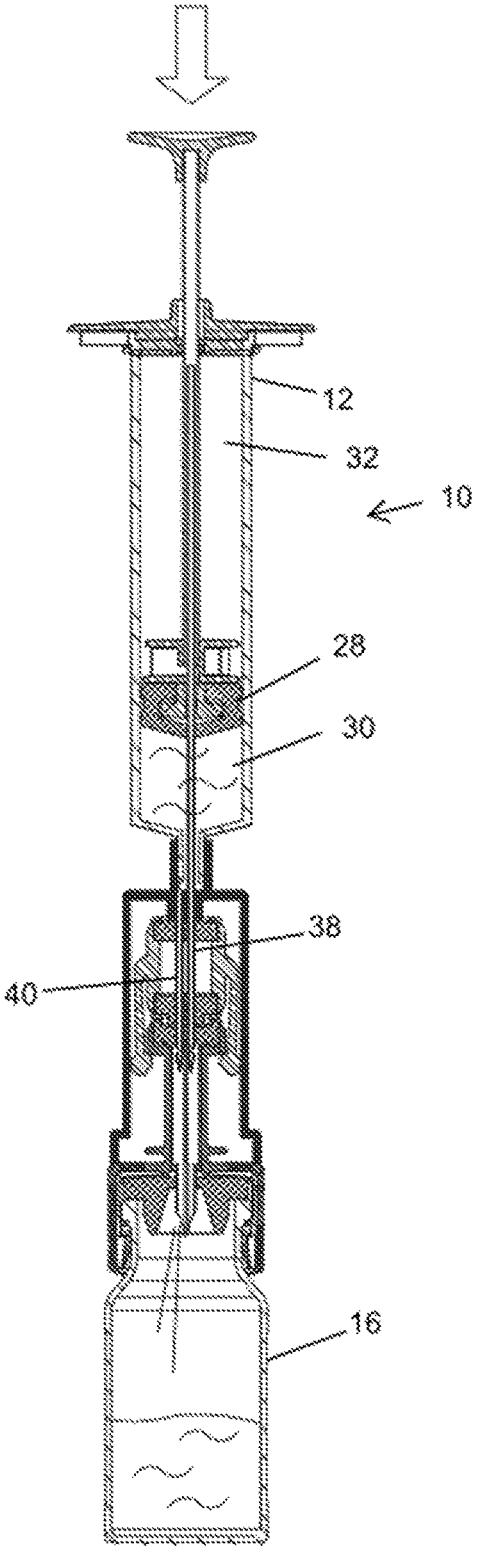
FIG. 3*a* and FIG. 3*b* are cross-sectional views that schematically show the concept of using the apparatus of FIG. 1 for transferring hazardous drugs.
Figure 3B:
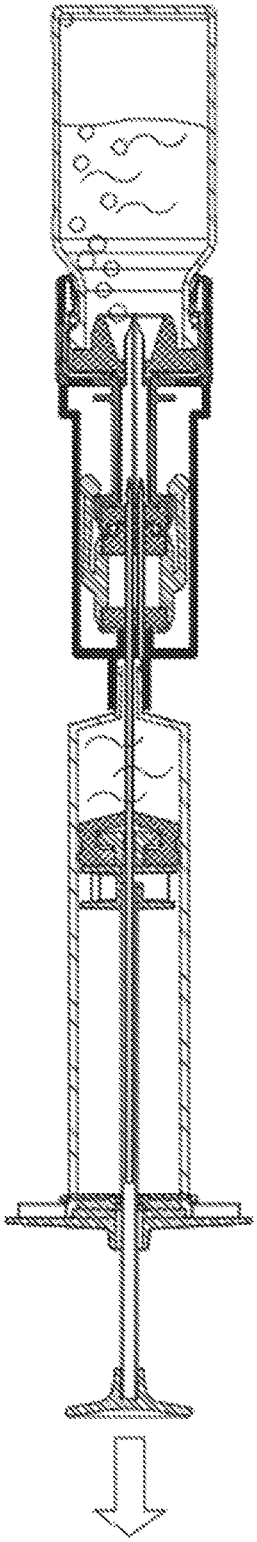

The embodiments of drug transfer apparatus shown in FIG. 1 and FIG. 2*a* do not comprise a hydrophobic filter barrier to separate the air channel from the liquid channel; therefore the method for discarding air bubbles which are naturally created during withdrawal of liquid from a vial is as follows: the bubbles are ejected from the syringe by disconnecting the vial and holding the syringe with the needles facing up, the air bubbles float naturally above the liquid in the syringe, then the plunger is depressed and the bubbles are pushed to the air chamber. For this procedure a communication between both needle ports is necessary, as exists in the embodiment of the connector 14 shown in FIG. 12.

Figure 13B:
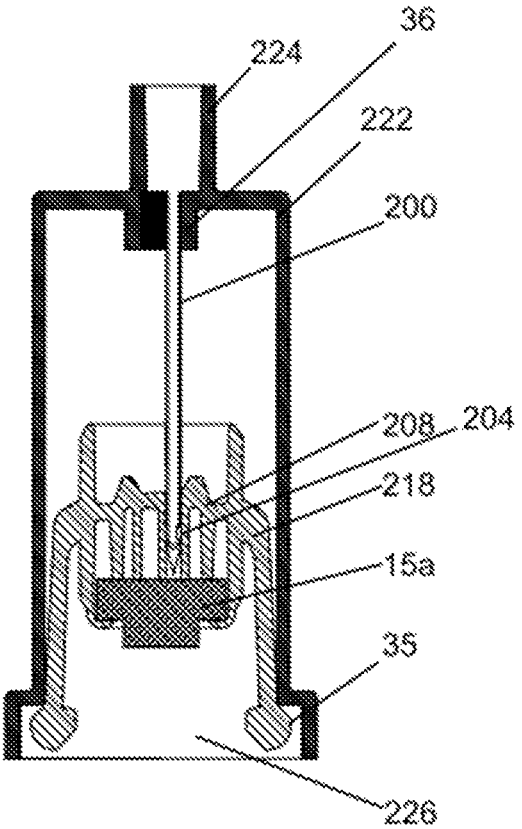
FIG. 13*b* shows the connector and adapter of FIG. 13*a* connected together.
Figure 13B:
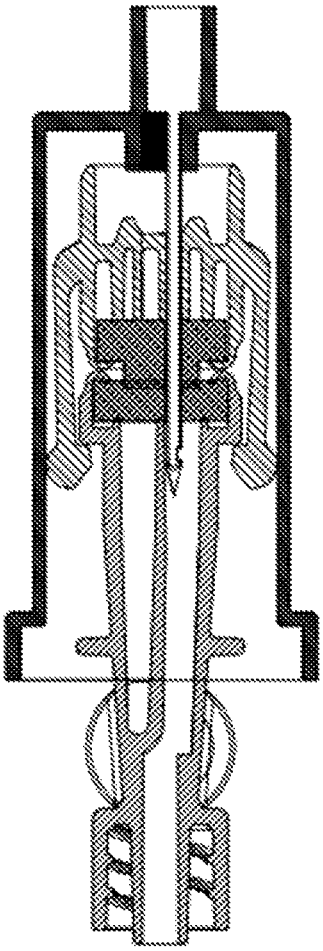
Figure 13A:
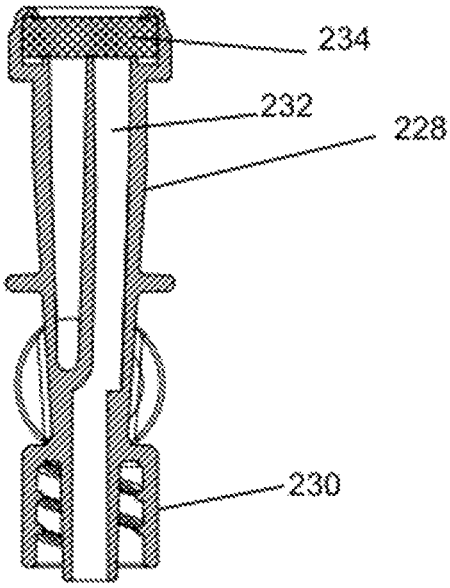
FIG. 13*a* schematically shows a connector comprising an actuator comprising a needle valve of the invention and an adapter configured to connect the connector to a component of a drug transfer apparatus.

FIG. 13*a* schematically shows a connector 222 comprising an actuator 218 comprising a needle valve of the invention and an adapter 228 configured to connect the connector 222 to a component of a drug transfer apparatus. FIG. 13*b* shows the connector 222 and adapter 228 of FIG. 13*a* connected together.

Connector 222 comprises at its proximal end a connection port 224 e.g. a female Luer lock, adapted to be connected to a component of a drug transfer apparatus, e.g. a needless syringe or an IV tubing; a single needle 200 comprising a smooth surfaced hollow shaft and a port 204 located in the side of the shaft at the distal end close to the tip; an actuator 218 comprising the seat of a needle valve of the invention 208. A membrane 15*a* located below the seat 208, and arms 35; and an open distal end 226. The proximal end of needle 200 is fixedly attached to the housing of connector 222 by needle holder 36. The interior of the needle is in fluid communication with the interior of connection port 224. As described herein above, the needle 200 fit slidingly in the bore in seat 208 and prevents fluid from passing through the bore.

Adapter 228 comprises a membrane 234 at its proximal end, an elongated body adapted to fit into the open distal end 226 of connector 222, and at its distal end a connection port 230 e.g. a threaded male Luer lock, adapted to be connected to a component of a drug transfer apparatus, e.g. an IV tubing set. A channel 232 passes through the length of adapter 228 from below membrane 234 through connection port 230.

To connect connector 222 and adapter 228 the proximal end of the adapter is inserted into open distal end 226 of the connector and advanced until membrane 234 contacts membrane 15*a*. Further pushing of connector and adaptor together causes the tip of needle 200 out of seat of the valve 208 and through membranes 15*a* and 234 into channel 232, thereby locking connector 222 and adapter 228 together by means of arms 35, as shown in FIG. 13*b*, and establishing an open fluid path from connection port 224 on connector 222 to connection port 230 on adapter 228.

The connector shown in FIG. 13*a* like the connector shown in FIG. 10*a* through FIG. 11*b* prevents all problems associated with high pressures in general and those specifically created during accidental pushing the of plunger. As can be seen in this figure, when the connector 222 is not connected to the adapter 234, the port 204 at the distal end of needle 200 that allows exchange of fluid between the surroundings and the hollow interior of the needle is blocked by the interior of the bore in seat 208 of the needle valve. If a syringe filled or partially filled with liquid is attached to connection port 224, then no matter how much force is exerted to try to push the plunger forward and to force liquid to flow through the needle, no liquid can exit the needle through port 204. Conversely, no matter how much force is exerted to pull the plunger backwards no air can enter through port 204 and flow through the interior of the needle into the barrel of the syringe.

Figure 14:
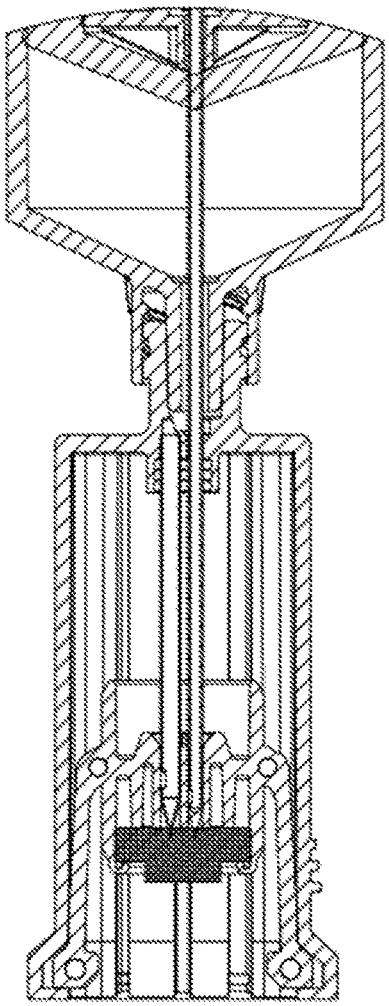
FIG. 14 and FIG. 15 show engineering drawings of the connectors described in FIG. 10*a* to FIG. 12.
Figure 15:
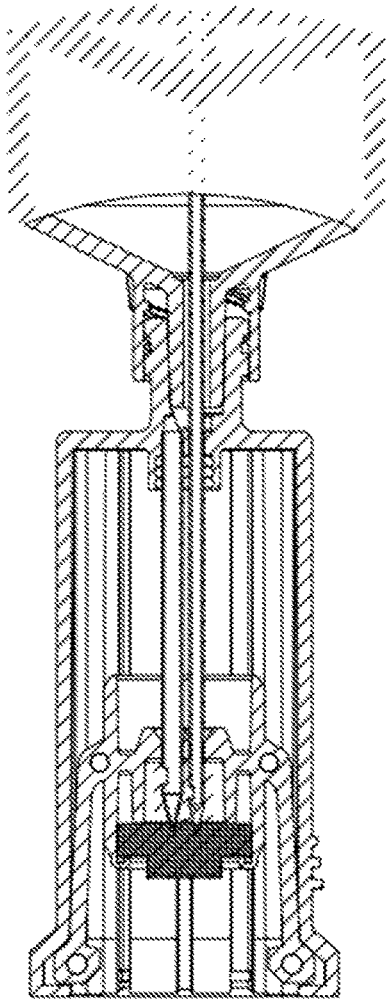

FIG. 14 and FIG. 15 are engineering drawings of two embodiments of a connector comprising needle valves according to the present invention. In the embodiment shown in FIG. 14 the ports near the tips of both the air and the liquid conduit are fully sealed and isolated from each other. In the embodiment shown in FIG. 15 the ports near the tips of the air and the liquid conduit are open to allow fluid communication between them.

Although embodiments of the invention have been described by way of illustration, it will be understood that the invention may be carried out with many variations, modifications, and adaptations, without exceeding the scope of the claims.

The invention claimed is:

1. A needle valve comprised of:

a) at least one hollow needle comprised of a smooth surfaced hollow shaft and a port located in the side of said shaft at the distal end close to the tip of said hollow needle, said port adapted to allow fluid communication between the interior and the exterior of said hollow needle; and b) a seat made of rigid material, said seat comprising at least one bore adapted to accommodate one of said at least one hollow needles through said seat;

wherein:

i) said hollow needle can be pushed back and forth through said bore; and ii) the outer diameter of said hollow needle and the inner diameter of at least part of said bore are so closely matched that the presence of the shaft of said hollow needle in said bore blocks the passage of fluid through said part of said bore.

2. The needle valve of claim 1, wherein the seat is made of plastic with low friction properties.

3. The needle valve of claim 2, wherein the plastic with low friction properties is acetal plastic.

4. The needle valve of claim 1, comprising a lubricant for reducing the friction between the needle and the seat.

5. A connector for connecting two components of a fluid transfer apparatus to each other, said connector comprising:

i) a cylindrical, hollow outer body;

ii) a connection port adapted to connect to a first fluid transfer component, said connection port located on the outside of said outer body at its proximal end;

iii) a needle holder located on the inside of said outer body at its proximal end;

iv) a needle that functions as a fluid conduit, wherein said needle passes through and is rigidly attached to said needle holder, the distal end of said needle comprises at least one port that allows fluid communication between the outside and the inside of said needle;

v) a single membrane seal actuator reciprocally displaceable within the hollow interior of said connector; said single membrane seal actuator comprising:

a cylindrical actuator casing;

a distal membrane that seals the distal end of said casing, wherein a part of said distal membrane protrudes distally from said casing; and at least one resilient arm which is connected at a proximal end thereof to an intermediate portion of the exterior of said casing and comprises enlarged locking elements at its distal end; said enlarged locking element having specifically shaped surface areas which interact with an inner wall of said cylindrical, hollow outer body of said connector to enable a four step procedure for connecting or separating said connector to a second fluid transfer component;

said connector characterized in that said single membrane seal actuator comprises a rigid plastic needle valve seat located proximally of said membrane, said needle valve seat comprising a bore, wherein said bore is adapted to each allow said needle to be pushed back and forth through it and at least a portion of each of said bore is adapted such that fluid cannot pass through said portion when said needle is at least partially located in said bore;

wherein, said connector is configured to allow a head portion of said second fluid transfer component to enter the interior of said connector and to allow said single membrane actuator to be pushed proximally when said membrane at its distal end is contacted by a membrane located in said head portion of said second fluid transfer component; whereupon further pushing of said membranes together causes said distal end of said needle to exit the distal end of said bore and to penetrate said membrane in said single membrane actuator and to penetrate said membrane in said head portion, thereby establishing a fluid channel via said needle between said connection port and the interior of said second fluid transfer component.

6. The connector of claim 5, wherein the port at the distal end of needle that allows exchange of fluid between the surroundings and the hollow interior of said needle is completely blocked by the interior of the bore in seat of the needle valve when said connector is not connected to a second fluid transfer component.

7. A fluid transfer apparatus comprising:

a) a syringe-like proximal section comprising:

i) a cylindrical body;

ii) a piston that is displaceable within said cylindrical body, said piston defining a distal liquid chamber and a proximal gas chamber, both of variable volume;

b) a connector section attached to the distal end of said proximal section, wherein the distal end of said connector section is adapted to be connectable to a fluid transfer component, said connector section comprising:

i) a cylindrical, hollow outer body;

ii) a needle holder;

iii) a first needle that functions as a liquid conduit, wherein said first needle passes through and is rigidly attached to said needle holder, the distal end of said first needle comprises at least one port that allows fluid communication between the outside and the inside of said first needle, the distal end of said first needle is located in said connector section, and the proximal end of said first needle is located in said liquid chamber;

iv) a second needle that functions as a gas conduit, wherein said second needle passes through and is rigidly attached to said needle holder, the distal end of said second needle comprises at least one port that allows fluid communication between the outside and the inside of said second needle, the distal end of said second needle is located in said connector section, and the proximal end of said second needle is located in said gas chamber;

v) a single membrane seal actuator reciprocally displaceable within the hollow interior of said connector section; said single membrane seal actuator comprising:

a cylindrical actuator casing;

a distal membrane that seals the distal end of said casing, wherein a part of said distal membrane protrudes distally from said casing; and at least one resilient arm which is connected at a proximal end thereof to an intermediate portion of the exterior of said casing and comprises enlarged locking elements at its distal end; said enlarged locking element having specifically shaped surface areas which interact with an inner wall of said cylindrical, hollow outer body of said connector section to enable a four step procedure for connecting or separating said connector section to a fluid transfer component;

said fluid transfer apparatus characterized in that said single membrane seal actuator comprises a rigid plastic needle valve seat located proximally of said membrane, said needle valve seat comprising two bores, wherein each of said bores is adapted to each allow one of said first and second needles to be pushed back and forth through it and at least a portion of each of said bores is adapted such that fluid cannot pass through said portion when said first and second needles are at least partially located in the respective one of said bores;

wherein, said connector section is configured to allow a head portion of said fluid transfer component to enter the interior of said connector section and to allow said single membrane actuator to be pushed proximally when said membrane at its distal end is contacted by a membrane located in said head portion of said fluid transfer component; whereupon further pushing of said membranes together causes said distal ends of said first needle and said second needle to exit the distal end of their respective bores and to penetrate said membrane in said single membrane actuator and to penetrate said membrane in said head portion, thereby establishing a liquid channel via said first needle between the interior of said liquid chamber and the interior of said fluid transfer component and a separate gas channel via said second needle between the interior of said gas chamber and the interior of said fluid transfer component.

8. The fluid transfer apparatus of claim 7, wherein the ports at the distal ends of both the first needle and the second needle are located in the seat of needle valve and are fully sealed by the bores in which they are located thereby isolating the interiors of said first needle and said second needle from each other when the distal end of the connector section is not attached to any other fluid transfer component.

9. The fluid transfer apparatus of claim 7, wherein the ports at the distal ends of both the first needle and the second needle are located in the seat of needle valve and are open thereby allowing fluid communication between the interiors of said first needle and said second needle when the distal end of the connector section is not attached to any other fluid transfer component.

* * * * *